US011738256B2

(12) United States Patent
Ondov

(10) Patent No.: US 11,738,256 B2
(45) Date of Patent: Aug. 29, 2023

(54) SPELLING GAME COMPRISING REMOVABLE TOKENS POSITIONED ON A TRACK

(71) Applicant: Brian Ondov, Washington, DC (US)

(72) Inventor: Brian Ondov, Washington, DC (US)

( * ) Notice: Subject to any disclaimer, the term of this patent is extended or adjusted under 35 U.S.C. 154(b) by 119 days.

(21) Appl. No.: 17/326,479

(22) Filed: May 21, 2021

(65) Prior Publication Data

US 2022/0370889 A1 Nov. 24, 2022

(51) Int. Cl.
*A63F 3/04* (2006.01)
*A63F 3/00* (2006.01)

(52) U.S. Cl.
CPC ..... *A63F 3/0423* (2013.01); *A63F 3/00634* (2013.01); *A63F 3/00694* (2013.01); *A63F 2003/0063* (2013.01); *A63F 2003/00996* (2013.01); *A63F 2003/0426* (2013.01)

(58) Field of Classification Search
CPC ..... A63F 3/0423; A63F 3/00634; A63F 3/00694; A63F 2003/0063; A63F 2003/00996; A63F 2003/0426; A63F 2007/346; A63F 2007/3637; A63F 2007/4006; A63F 7/3622; A63F 2007/405; A63F 2007/343; A63F 2011/0048; A63F 3/3622
See application file for complete search history.

(56) References Cited

U.S. PATENT DOCUMENTS 1,566,730 A * 12/1925 Butler ..... A63F 7/044 273/115
2,017,473 A * 10/1935 Reimert ..... A63F 3/0423 273/281
2,167,915 A 8/1939 Sweet
2,218,375 A * 10/1940 Axelrod ..... A63F 9/0098 273/120 R (Continued)

FOREIGN PATENT DOCUMENTS

JP 2006181246 7/2006

OTHER PUBLICATIONS

Yeany—YouTube video titled "Physics marble track review part one / / Homemade Science with Bruce Yeany", published Oct. 29, 2017 at https://www.youtube.com/watch?v=JWtsOiVxIIE (Year: 2017).*

(Continued)

*Primary Examiner* — Michael D Dennis
(74) *Attorney, Agent, or Firm* — Ashley D. Johnson; Dogwood Patent and Trademark Law

(57) ABSTRACT

The presently disclosed subject matter is generally directed to an educational and entertaining game that includes a playing board and a plurality of game tokens. The game board includes a track configured as an internal channel for receiving a plurality of tokens. The board is configured such that the track includes a first height that gradually lowers to a second height. The difference in height allows the tokens to travel along the track in a single row. Each token includes an indicator that can be one or more letters, numbers, words, (Continued)

or symbols. The tokens can be removed from the track to spell words with the remaining tokens configured on the track. As a token is removed, the remaining tokens will travel towards the lower end of the board due to the sloped configuration of the track. In this way, the ordering of the tokens is preserved.

15 Claims, 22 Drawing Sheets

(56) References Cited

U.S. PATENT DOCUMENTS

| | | | | |
|---|---|---|---|---|
| 2,590,501 | A | 3/1952 | Brodes | |
| 4,004,811 | A | 1/1977 | Brandin | |
| 5,344,143 | A * | 9/1994 | Yule | A63F 7/3622 273/118 R |
| 5,427,529 | A | 6/1995 | Dunse | |
| 5,702,105 | A | 12/1997 | Glikmann | |
| 5,740,243 | A | 4/1998 | Rehm | |
| 6,386,538 | B1 | 5/2002 | Mejia | |
| 7,267,340 | B2 | 9/2007 | Hyra et al. | |
| 7,267,341 | B2 | 9/2007 | Shah | |
| 8,628,394 | B2 | 1/2014 | Patnoe | |
| 9,333,421 | B2 | 5/2016 | Walls | |
| 9,770,637 | B2 | 9/2017 | Cranford | |
| 9,895,601 | B1 | 2/2018 | Wilk | |
| 10,413,808 | B2 | 9/2019 | Spiridigliozi et al. | |
| 2004/0198145 | A1 | 10/2004 | Quercetti | |
| 2014/0084541 | A1 | 3/2014 | Hedgecock | |
| 2018/0029051 | A1 | 2/2018 | Simmons | |
| 2018/0290051 | A1* | 10/2018 | Hedgecock | A63F 3/0423 |
| 2021/0339117 | A1* | 11/2021 | Corpuz | A63F 13/2145 |

OTHER PUBLICATIONS

Magnetic Games—YouTube video titled "Magnetic Accelerators | Magnetic Games", published Nov. 7, 2020 at https://www.youtube.com/watch?v=fdoLXChlJ_4 (Year: 2020).*

International Search Report and Written Opinion dated Oct. 24, 2022.

* cited by examiner

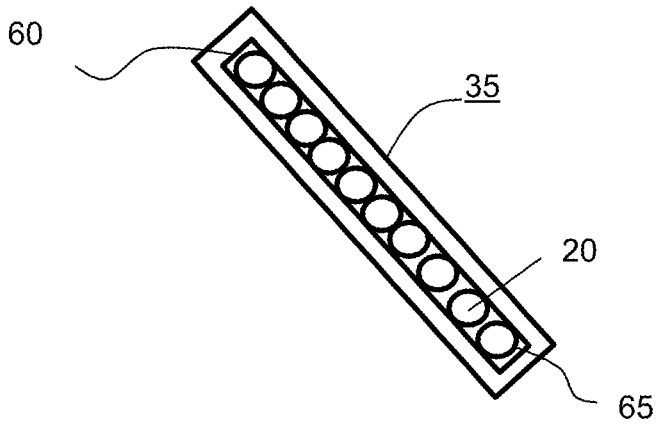
Fig. 17a
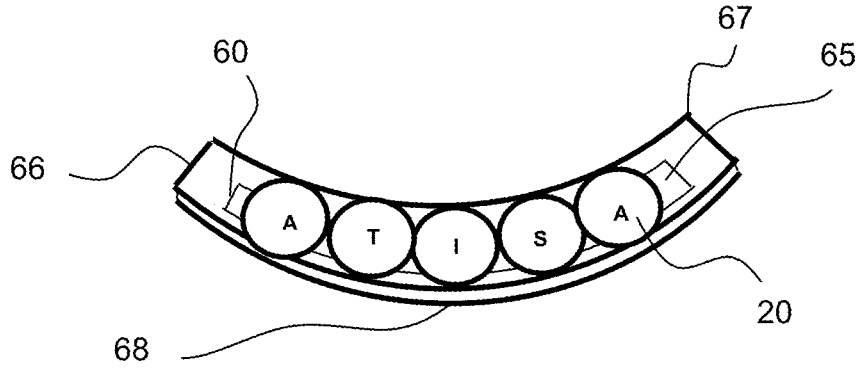
Fig. 17b
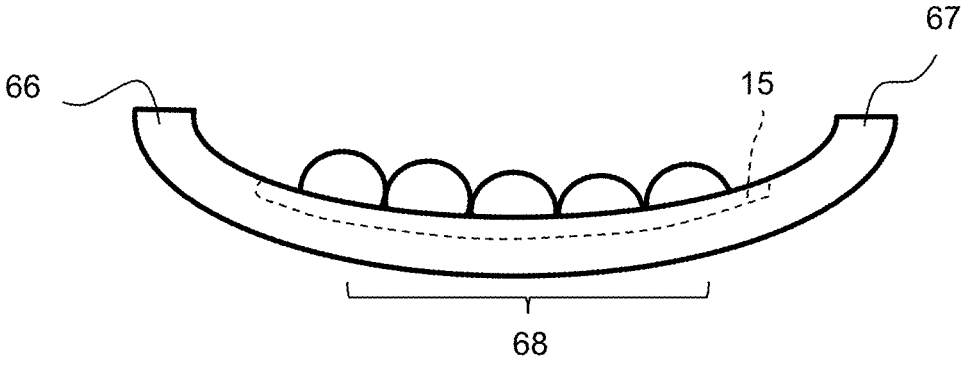
Fig, 17c

SPELLING GAME COMPRISING REMOVABLE TOKENS POSITIONED ON A TRACK

TECHNICAL FIELD

The presently disclosed subject matter is generally directed to a spelling game comprising removable tokens positioned on a track. The presently disclosed subject matter further includes methods of making and playing the game.

BACKGROUND

Word games are very common with people throughout the world. Particularly, the challenge of finding the correct letters to spell words appeals to many players. For this reason, spelling games represent a large category of board games, video games, and written puzzles. For example, prior art spelling games commonly embed letters in a fixed space (physical or virtual) and require words to be found given the spatial configuration of the letters. A simple example is a "word find" puzzle, in which predetermined words are arranged such that the letters form contiguous lines through the grid, either orthogonally or diagonally and often regardless of direction. The remainder of the grid is filled with random letters, concealing the words so that they are challenging to find. Another popular example is Boggle®, which includes a grid made up entirely of random letters. Words are found along arbitrary paths of letters that are adjacent orthogonally or diagonally. Other prior art spelling games provide players with a group (or "hand") of letters that are randomly chosen and have no intrinsic ordering. Players must create words by choosing and rearranging the letters to form a word. A common example is an anagram game, in which any configuration of the letters can be used to spell words. More complex games place restrictions on the words that can be spelled. For example, Dabble® requires the words to be of specific lengths and that all letters in the hand are used. The popular games Bananagrams® and Scrabble® are both crossword-building games and require letters from the hand to be placed contiguously among other letters in a grid, such that all horizontal and vertical sequences in the space form words. However, prior art spelling games are limited to placing pieces on a grid or arbitrarily rearranging tokens to form words. It would therefore be beneficial to provide a game that utilizes a sequence of physical pieces to create the mental challenge of forming words.

SUMMARY

In some embodiments, the presently disclosed subject matter is directed to a game apparatus. The apparatus is defined by a game board comprising a bottom support surface and a top playing surface with a height. The board further includes at least one track configured as a channel within the top playing surface, wherein each track includes a mechanism for advancing one or more tokens along the track. The apparatus includes a plurality of tokens sized and shaped to be at least partially housed within the one or more tracks in a received order. When a token is removed from a track, any tokens positioned before the removed token in the received order will advance towards tokens positioned after the removed token in the received order.

In some embodiments, the track is defined by a first end comprising a first height, a second end comprising a second height, a length spanning the first and second ends, wherein the first height is greater than the second height such that the track comprises a gradient from the first end to the second end and the mechanism that advances one or more tokens along the track is gravity.

In some embodiments, each token comprises an indicator selected from a single letter, two or more letters, a single word, two or more words, at least one number, at least one symbol, or combinations thereof.

In some embodiments, the track gradient is about 5-60 degrees relative to the horizontal.

In some embodiments, the track has a rounded, semi-circular, square, rectangular, triangular, notched, or abstract cross-sectional shape.

In some embodiments, the track has a spiral design.

In some embodiments, the track has a linear, zig-zag, angled, or curved shape.

In some embodiments, at least one track includes an adjacent lip configured along a length of the track, with a depth of about 0.1-1 inches.

In some embodiments, the mechanism that advances one or more tokens along the track is defined as a spring-loaded mechanism positioned at an end of the track.

In some embodiments, the track and plurality of tokens comprise magnets that attract each other.

In some embodiments, the tokens are spherical or cylindrical in shape.

In some embodiments, the tokens are cubes.

In some embodiments, the game board comprises first and second ends with a length therebetween, wherein the first and second ends have a height that is greater than the remainder of the game board length.

In some embodiments, the presently disclosed subject matter is directed to a method of playing a game. Specifically, the method includes positioning a plurality of tokens within a game board channel of an apparatus. The apparatus comprises a game board defined by a bottom support surface and a top playing surface with a height. The board further include at least one track configured as a channel within the top playing surface, wherein each track includes a mechanism that advances one or more tokens along the track. The apparatus includes a plurality of tokens sized and shaped to be at least partially housed within the one or more tracks in a received order. When a token is removed from a track, any tokens positioned before the removed token in the received order will advance towards tokens positioned after the removed token in the received order. The method includes removing one or more tokens by a first player to form a word using adjacent tokens positioned along the track. The method further includes awarding points to the first player based on the length of the word formed, the one or more tokens used to form the word, the speed with which the word was formed, or combinations thereof. The removing and awarding points steps are repeated for subsequent players to form a round. Subsequent rounds are then played. The method includes ending the game when a predetermined number of plays have been made for each player, when a player reaches a predetermined score, or when no more words can be formed, wherein the player with the highest number of points at the end of the game is declared the winner.

In some embodiments, the game is a video game, computer program, mobile application, or electronic game.

In some embodiments, each player is assigned their own track on the game board.

In some embodiments, each player shares a single track on the game board.

In some embodiments, a player can pass their turn instead of removing one or more tokens from the track.

In some embodiments, the indicator is selected from a single letter, two or more letters, a single word, two or more words, at least one number, at least one symbol, or combinations thereof.

In some embodiments, the track gradient is about 5-60 degrees relative to the horizontal.

In some embodiments, each track has a spiral, linear, zig-zag, angled, or curved shape.

In some embodiments, the track is defined by a first end comprising a first height, a second end comprising a second height, and a length spanning the first and second ends, wherein the first height is greater than the second height such that the track comprises a gradient from the first end to the second end and the mechanism that advances one or more tokens along the track is gravity.

In some embodiments, the mechanism that advances one or more tokens along the track is defined as a spring-loaded mechanism positioned at the first end of the track.

In some embodiments, the game board comprises first and second ends with a length therebetween, wherein the first and second ends have a height that is greater than the remainder of the game board length.

BRIEF DESCRIPTION OF THE DRAWINGS

FIG. 17*a* is a top plan view of a game board with a plurality of tokens positioned within the game board track in accordance with some embodiments of the presently disclosed subject matter.

FIG. 17*b* is a perspective view of a game board comprising first and second ends curved in an upward direction with a lower support portion that rests on a support surface.

FIG. 17*c* is a front plan view of a game board comprising first and second ends curved in an upward direction with a middle support portion that rests on a surface, such as a table.

DETAILED DESCRIPTION

Figure 1A:
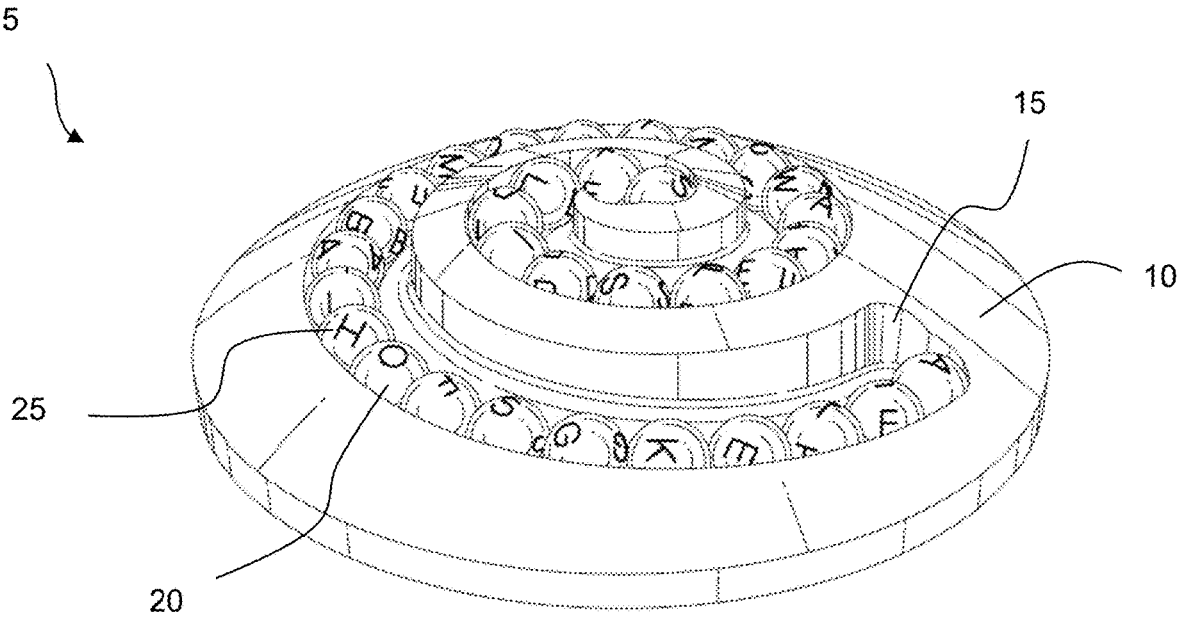
FIG. 1*a* is a perspective view of a game board comprising playing tokens in accordance with some embodiments of the presently disclosed subject matter.

The presently disclosed subject matter is introduced with sufficient details to provide an understanding of one or more particular embodiments of broader inventive subject matters. The descriptions expound upon and exemplify features of those embodiments without limiting the inventive subject matters to the explicitly described embodiments and features. Considerations in view of these descriptions will likely give rise to additional and similar embodiments and features without departing from the scope of the presently disclosed subject matter.

Unless defined otherwise, all technical and scientific terms used herein have the same meaning as commonly understood to one of ordinary skill in the art to which the presently disclosed subject matter pertains. Although any methods, devices, and materials similar or equivalent to those described herein can be used in the practice or testing of the presently disclosed subject matter, representative methods, devices, and materials are now described.

Following long-standing patent law convention, the terms "a", "an", and "the" refer to "one or more" when used in the subject specification, including the claims. Thus, for example, reference to "a device" can include a plurality of such devices, and so forth. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise indicated, all numbers expressing quantities of components, conditions, and so forth used in the specification and claims are to be understood as being modified in all instances by the term "about". Accordingly, unless indicated to the contrary, the numerical parameters set forth in the instant specification and attached claims are approximations that can vary depending upon the desired properties sought to be obtained by the presently disclosed subject matter.

As used herein, the term "about", when referring to a value or to an amount of mass, weight, time, volume, concentration, and/or percentage can encompass variations of, in some embodiments +/−20%, in some embodiments +/−10%, in some embodiments +/−5%, in some embodiments +/−1%, in some embodiments +/−0.5%, and in some embodiments +/−0.1%, from the specified amount, as such variations are appropriate in the disclosed packages and methods.

As used herein, the term "and/or" includes any and all combinations of one or more of the associated listed items.

Relative terms such as "below" or "above" or "upper" or "lower" or "horizontal" or "vertical" may be used herein to describe a relationship of one element, layer, or region to another element, layer, or region as illustrated in the drawing figures. It will be understood that these terms and those discussed above are intended to encompass different orientations of the device in addition to the orientation depicted in the drawing figures.

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

Figure 1B:
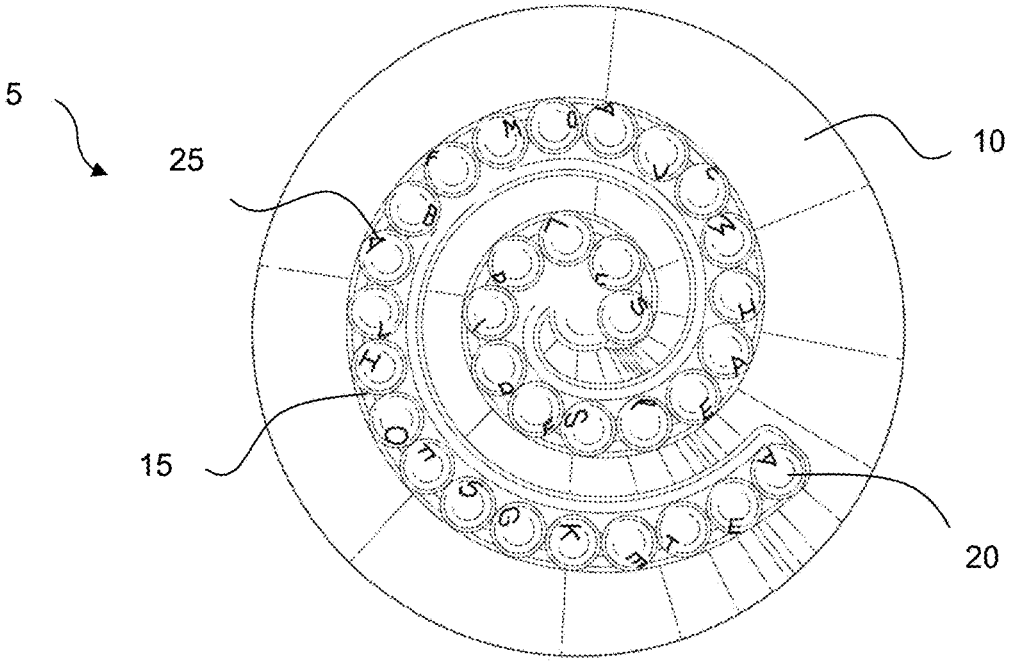
FIG. 1*b* is a top plan view of the game board of FIG. 1*a* in accordance with some embodiments of the presently disclosed subject matter.

The presently disclosed subject matter is generally directed to an educational and entertaining game that includes a playing board and a plurality of game tokens. FIGS. 1*a* and 1 *b* illustrate one embodiment of game 5 comprising playing board 10 defined by track 15. As illustrated, the track includes an internal channel for receiving a plurality of tokens 20. As described in more detail below, board 10 is configured such that the track includes a first height that gradually lowers to a second height. The difference in height allows tokens 20 to travel along the track in a single row. As shown, each token includes indicator 25, which can be one or more letters, numbers, words, or symbols. Tokens 20 can be removed from the track to spell words with the remaining tokens configured on the track. As a token is removed, the remaining tokens will travel towards the lower end of the board due to the sloped configuration of the track. In this way, the ordering of the tokens is preserved.

Figure 2:
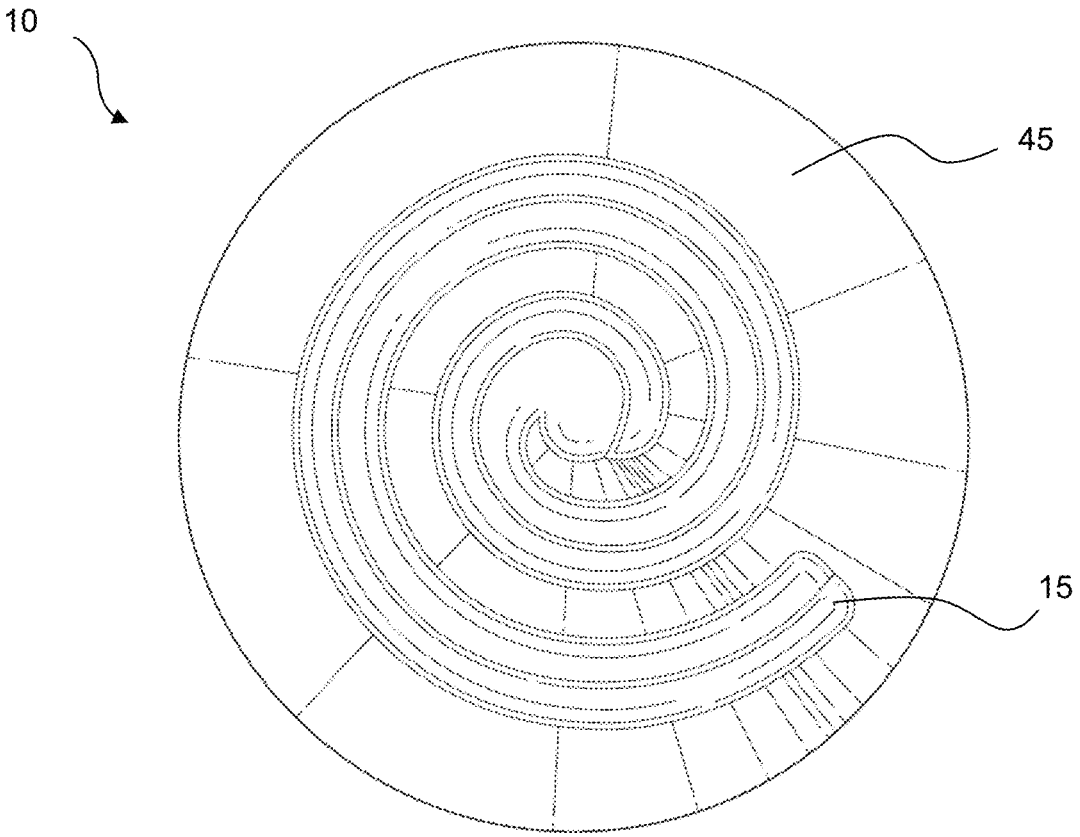
FIG. 2 is a top plan view of a game board in accordance with some embodiments of the presently disclosed subject matter.
Figure 3A:
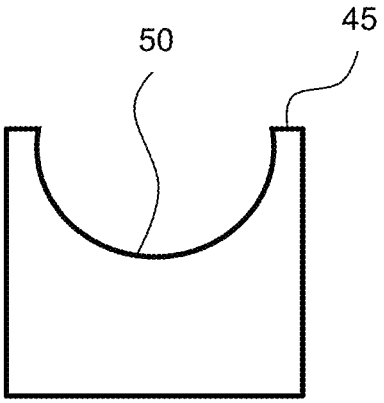
FIG. 3*a* is a cross-sectional view of a board track with a rounded configuration in accordance with some embodiments of the presently disclosed subject matter.
Figure 3B:
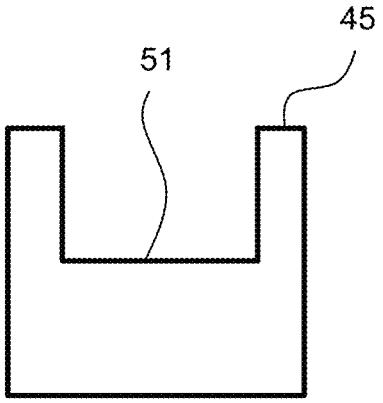
FIG. 3*b* is a cross-sectional view of a board track with a rectangular configuration in accordance with some embodiments of the presently disclosed subject matter.
Figure 3C:
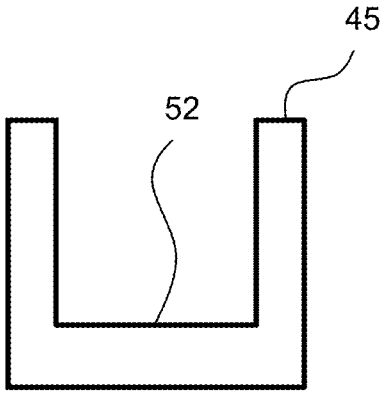
FIG. 3*c* is a cross-sectional view of a board track with a square configuration in accordance with some embodiments of the presently disclosed subject matter.
Figure 3D:
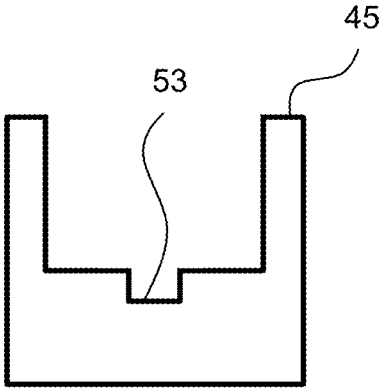
FIG. 3*d* is a cross-sectional view of a board track with a notched configuration in accordance with some embodiments of the presently disclosed subject matter.
Figure 3E:
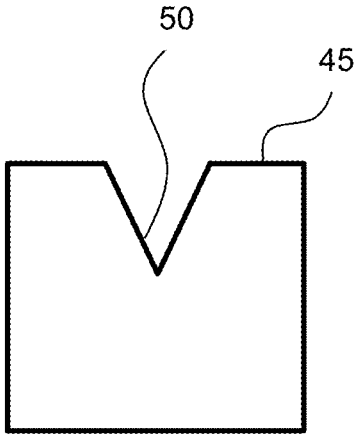
FIG. 3*e* is a cross-sectional view of a board track with a triangular configuration in accordance with some embodiments of the presently disclosed subject matter.
Figure 3F:
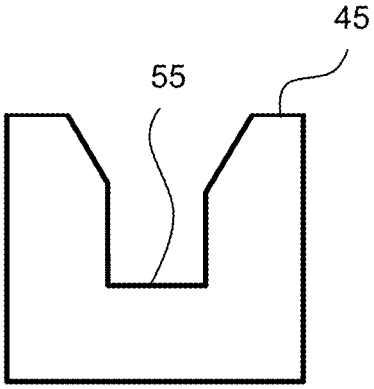
FIG. 3*f* is a cross-sectional view of a board track with an abstract configuration in accordance with some embodiments of the presently disclosed subject matter.

FIG. 2 illustrates one embodiment of playing board 5 comprising substantially flat bottom surface 30 (not shown) that allows the board to rest on a support surface, such as a table or the floor. Board 5 further includes body 35 with a non-uniform height. The term "non-uniform" refers to the characteristic having a maximum height that is greater than a minimum height. The term "height" refers to a characteristic dimension, generally along a substantially vertical direction. In some embodiments, the difference between the maximum and minimum board heights can be about 2-10 inches (e.g., at least/no more than about 2, 3, 4, 5, 6, 7, 8, 9, 10, 11, 12, 13, 14, 15, 16, 17, 18, 19, or 20 inches). However, the presently disclosed subject matter is not limited and the board can have maximum and minimum heights outside the given range.

The game board body includes track 15 configured as an elongated channel positioned within top surface 45 of the board. Thus, the track can have one or more sides that define an interior cavity or slot. The track can have any desired cross-sectional shape, such as (but not limited to) rounded shape 50, rectangular shape 51, square shape 52, notched shape 53, triangular shape 54, abstract shape 55, and the like as shown in FIGS. 3*a*-3*f*. However, it should be appreciated that the cross-sectional shape of track 15 is not limited so long as it cooperates with corresponding tokens 20.

Figure 4A:
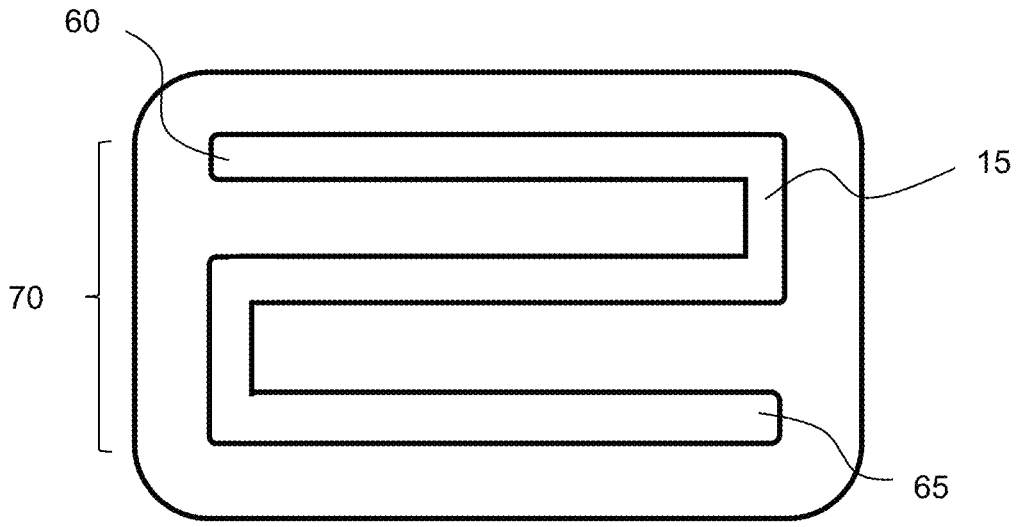
FIG. 4*a* is a top plan view of a game board comprising a winding track in accordance with some embodiments of the presently disclosed subject matter.
Figure 4B:
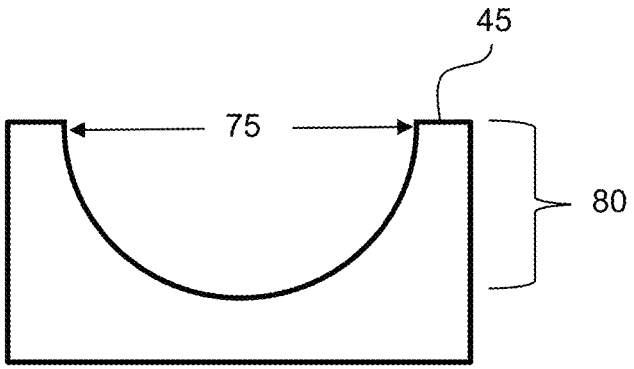
FIG. 4*b* is a side plan view the game board of FIG. 4*a* in accordance with some embodiments of the presently disclosed subject matter.

As shown in the embodiments of FIGS. 4*a* and 4*b*, track 15 includes first end 60, opposed second end 65, and track length 70 spanning the two ends. First track end 60 can be positioned at or adjacent to maximum height 40 of the board. Similarly, second track end 65 can be positioned at or near minimum height 41 of the board. Accordingly, track 15 slants in a downward direction as it travels from first end 60 to second end 65. The inclined track is designed to allow tokens 20 to travel along the length of the track, toward the second (lower) end.

Track length 70 can vary depending on the size of the board, the shape of the track, etc. For example, in some embodiments, the track can have length 70 of about 10-100 inches. Thus, the distance between the track first and second ends 60, 65 can be at least about (or no more than about) 10, 15, 20, 25, 30, 35, 40, 45, 50, 55, 60, 65, 70, 75, 80, 85, 90, 95, or 100 inches. However, it should be appreciated that the presently disclosed subject matter is not limited and the track can be configured with a length greater or less than the range given above.

Track 15 can further include width 75 that spans two opposing sides of the channel, as illustrated in FIG. 4*b*. The term "width" therefore refers to the maximum distance between two opposed surfaces of the track. In some embodiments, the track width can be about 0.5-2 inches (e.g., at least/no more than about 0.5, 0.75, 1, 1.25, 1.5, 1.75, or 2 inches). However, the presently disclosed subject matter is not limited and the track width can be outside the given range.

Figure 4C:
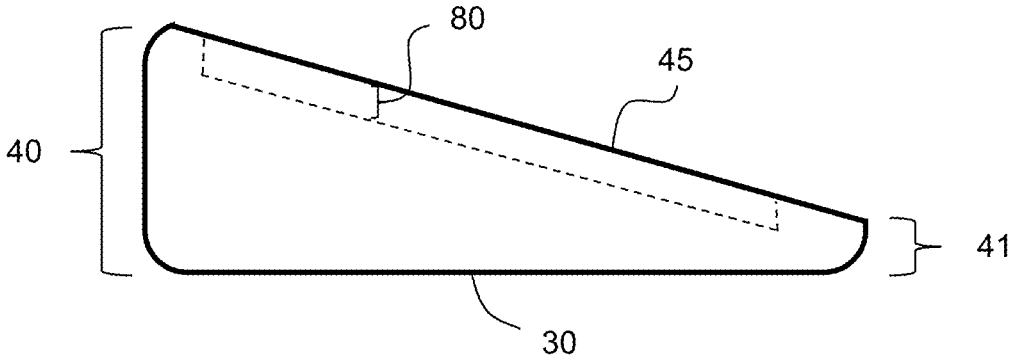
FIG. 4*c* is a cross-sectional view of a board track illustrating the track width and depth in accordance with some embodiments of the presently disclosed subject matter.

FIG. 4*c* further illustrates that track 15 includes depth 80 sized to accommodate at least a portion of corresponding tokens 20. The term "depth" refers to the distance between the lowest portion of the track and top face 45 of the board. The track can include any suitable depth, such as (but not limited to) about 0.5-2 inches (e.g., at least/no more than about 0.5, 0.75, 1, 1.25, 1.5, 1.75, or 2 inches). However, the presently disclosed subject matter is not limited and the width and depth of the track can vary as desired by the user.

Figure 4D:
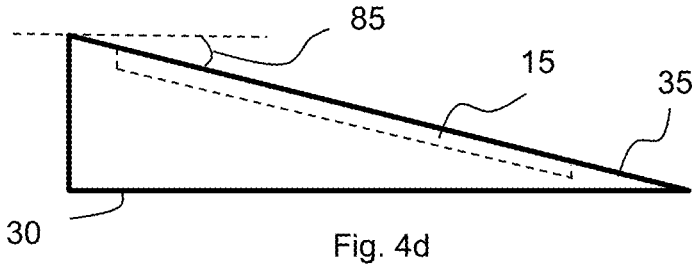
FIG. 4*d* is a side plan view of a board track illustrating a sloped angle in accordance with some embodiments of the presently disclosed subject matter.
Figure 4E:
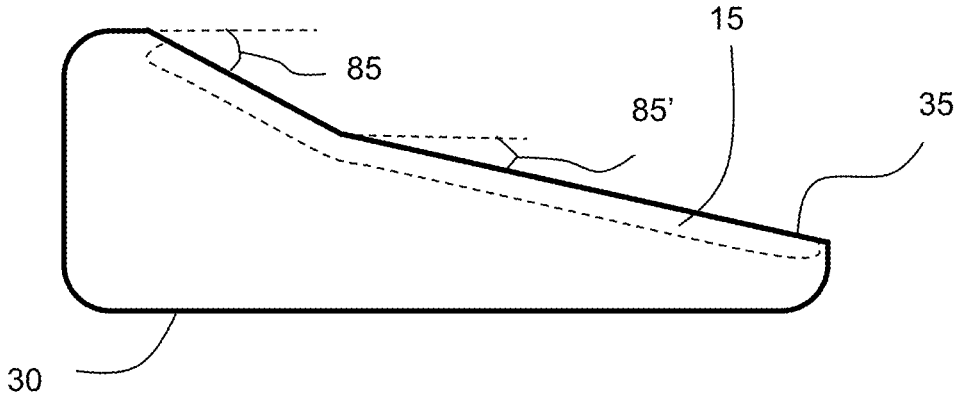
FIG. 4*e* is a side plan view of a board track comprising two sloped angles in accordance with some embodiments of the presently disclosed subject matter.

In some embodiments, the track and/or top face of the base includes angle 85 of about 5-60 degrees relative to the horizontal, as shown in FIG. 4*d*. Thus, angle 85 can be at least about (or no more than about) 5, 10, 15, 20, 25, 30, 35, 40, 45, 50, 55, or 60 degrees). The angle of track 15 can be consistent along length 70, from first end 60 to second end 65. However, the presently disclosed subject matter is not limited and the track can vary with regard to angle 85. For example, the angle can be steeper closer to first end 60 and more gradual (85') as it travels towards second end 65, as shown in the embodiment of FIG. 4*e*. A gradient is therefore created along the length of each track.

Figure 5A:
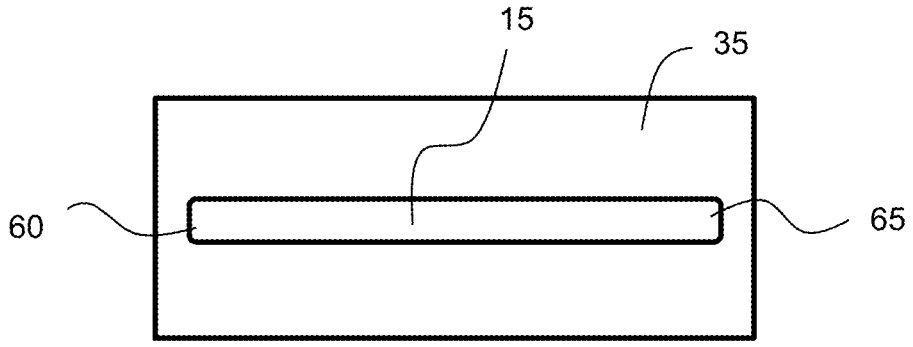
FIGS. 5*a*-5*e* are top plan views of game boards comprising a linear, zig-zag, angled, curved, and combination track design, respectively, in accordance with some embodiments of the presently disclosed subject matter.
Figure 5B:
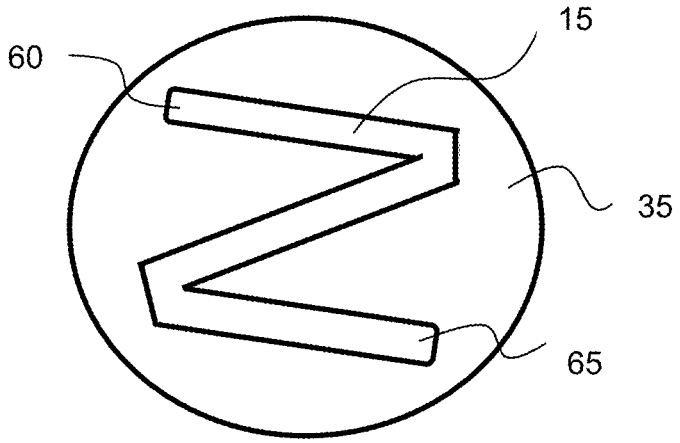
Figure 5C:
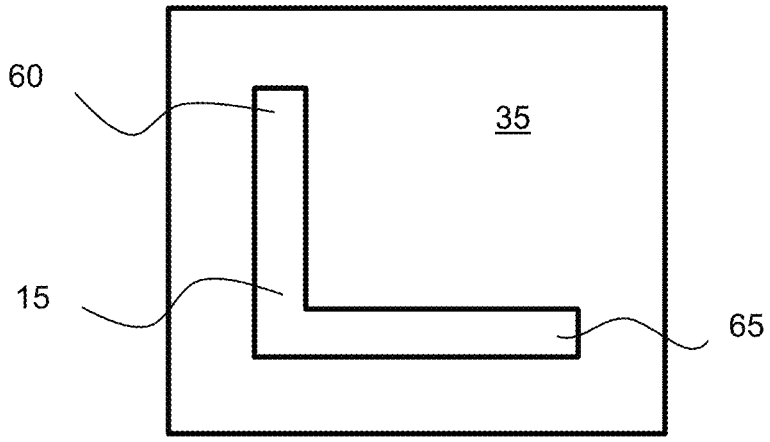
Figure 5D:
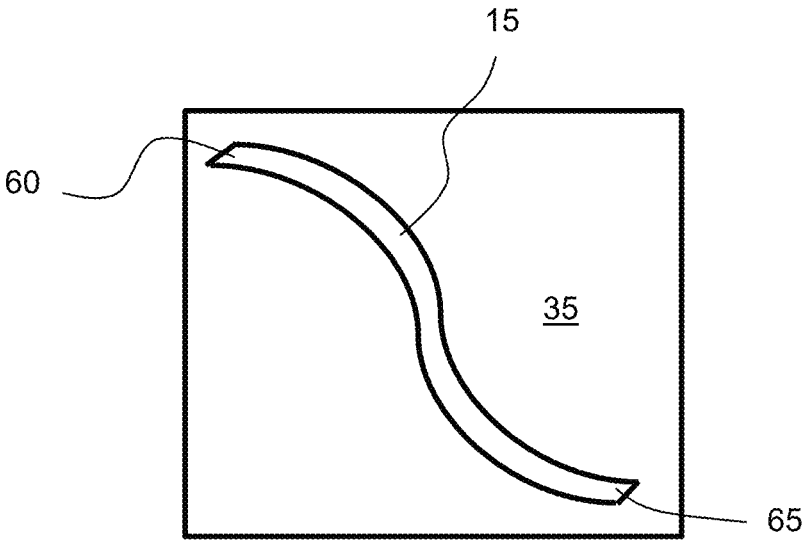
Figure 5E:
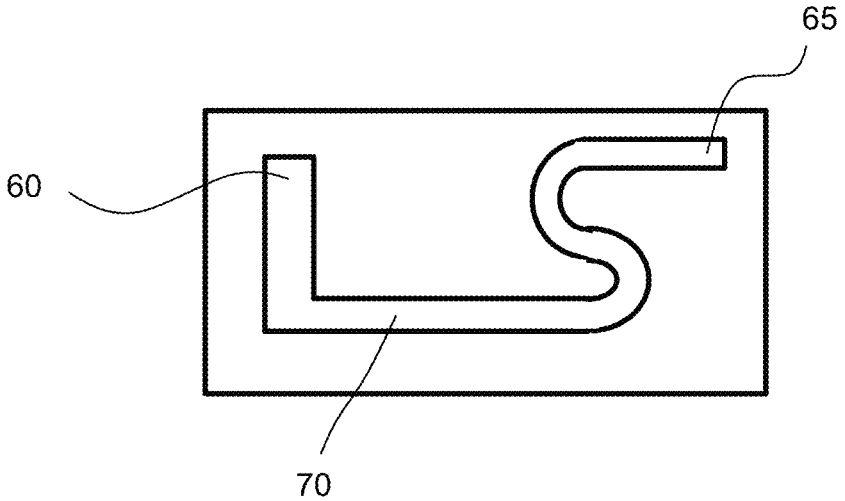

Track 15 can be configured in any desired shape, such as the spiral design of FIG. 1*a* and the winding pattern of FIG. 4*a*. The track can further include a linear design, zig-zag, angled pattern, or curved design, as illustrated in FIGS. 5*a*-5*d*. It should be appreciated that the track can include any desired configuration. Further, the track can include combinations of more than one track design, as illustrated in FIG. 5*e*. Thus, the track can be configured in any linear, curved, curvilinear, or rectilinear path or series of paths embedded in a sloped surface.

Figure 6:
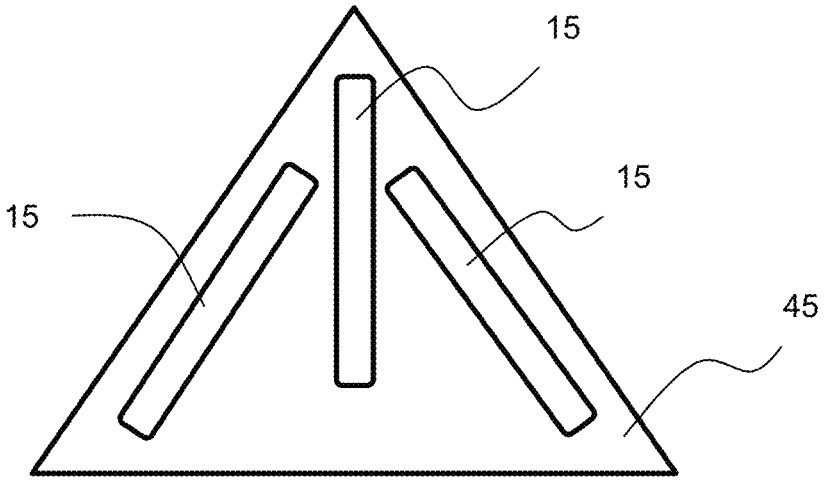
FIG. 6 is a top plan view of a game board comprising a multi-track design in accordance with some embodiments of the presently disclosed subject matter.

In some embodiments, each board can include a single track 15. However, the presently disclosed subject matter also includes embodiments where a plurality of tracks are configured on the top face of a single board, as shown in FIG. 6. It should be appreciated that the board can include any desired number of tracks, such as (but not limited to) about 1-10 or more.

Figure 7A:
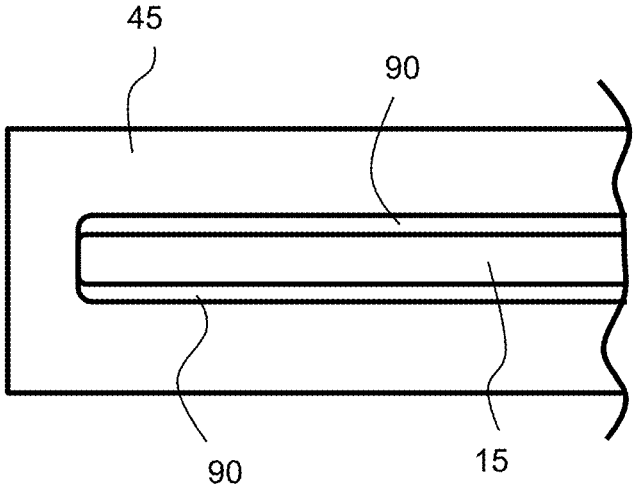
FIG. 7*a* is a top plan views of game board tracks comprise an adjacent lip in accordance with some embodiments of the presently disclosed subject matter.
Figure 7B:
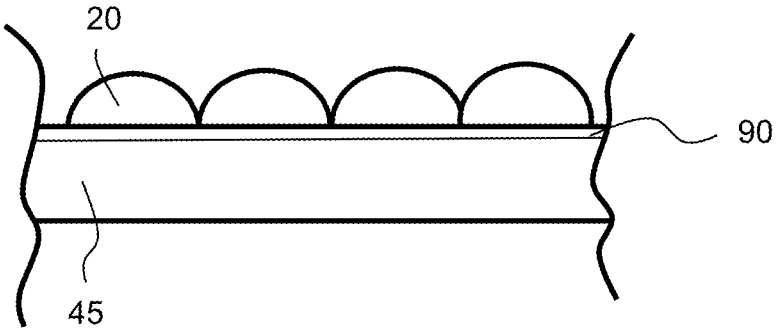
FIG. 7*b* is a cross-sectional view of a game board track comprising a lip in accordance with some embodiments of the presently disclosed subject matter.
Figure 7C:
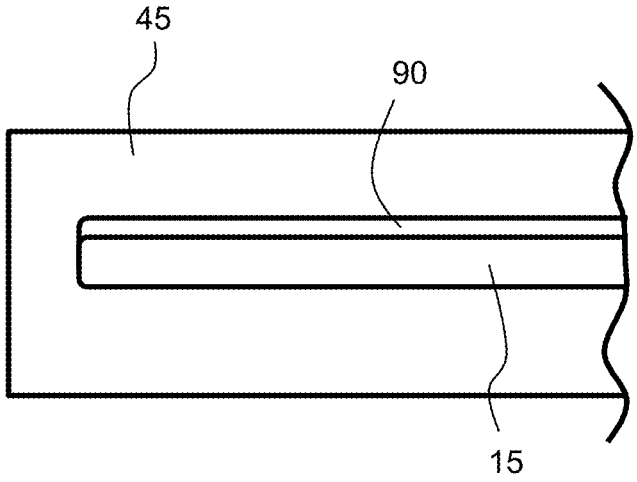
FIG. 7*c* is a top plan views of game board tracks comprise an adjacent lip in accordance with some embodiments of the presently disclosed subject matter.

Optionally, the side edges of track 15 can be flanked by shallow lip 90, creating space for players to insert their fingers to grip a token for removal. One embodiment of lip 90 is illustrated in FIGS. 7*a* and 7*b*. The term "lip" can refer to a shallow indentation or any element that allows the user to better grip one or more tokens. Lip 90 can have a depth of about 0.1-1 inches (e.g., at least/no more than about 0.1, 0.2, 0.3, 0.4, 0.5, 0.6, 0.7, 0.8, 0.9, or 1 inches) in some embodiments. However, the lip can have any desired depth. Lip 90 can span both sides of the track as shown in FIG. 7*a*. Alternatively, the lip can be positioned on only a single side, as shown in FIG. 7*c*.

Figure 8A:
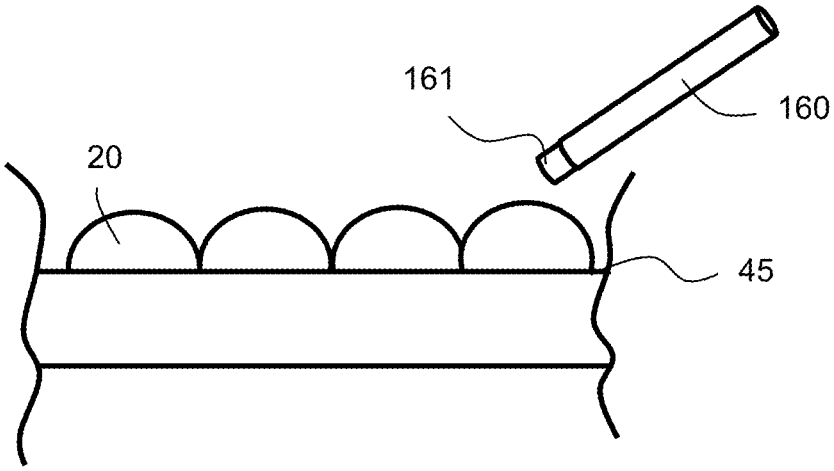
FIG. 8*a* is a side plan view of a removal device in accordance with some embodiments of the presently disclosed subject matter.
Figure 8B:
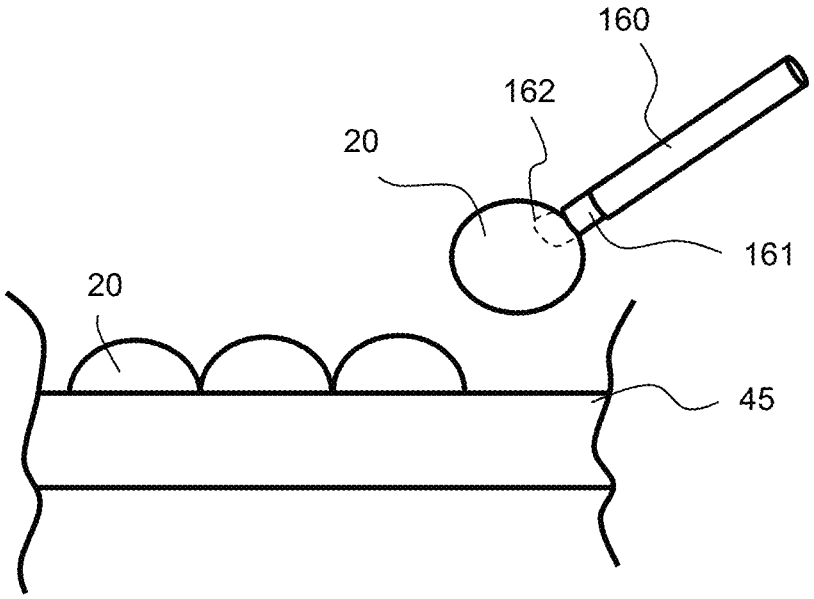
FIG. 8*b* is a side plan view of the device of FIG. 8*a* with an attached token in accordance with some embodiments of the presently disclosed subject matter.
Figure 8C:
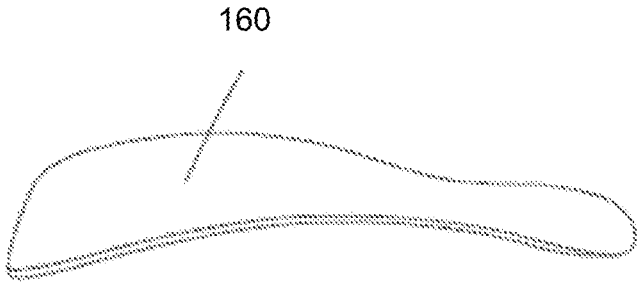
FIG. 8*c* is a perspective view of a removal device in accordance with some embodiments of the presently disclosed subject matter.

Optionally, the game can include one or more removal devices that facilitate removal of times from track 15. One embodiment of removal device 160 is shown in FIGS. 8*a* and 8*b*. As illustrated, removal device 160 can include any element that attracts or holds one or more tokens 20 to allow removal from the track. For example, the device can include attractor 161 configured at a first end of the device. The attractor cooperates with one or more tokens to remove a token. Thus, attractor 161 can be a magnet that attracts a magnetic coating or internal magnet 162 within each token. Alternatively, attractor 161 can be VELCRO® or any other element that cooperates with a corresponding element or coating on tokens 20. In another embodiment, device 160 can be configured as a shoehorn or other scoop-like shape to remove tokens 20, as illustrated in FIG. 8*c*.

Figure 9A:
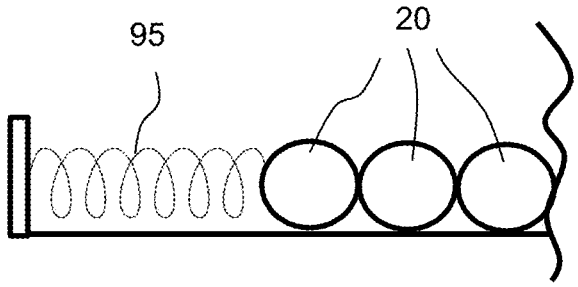
FIG. 9*a* is a side plan view illustrating a game board track comprising a spring-loaded element in accordance with some embodiments of the presently disclosed subject matter.
Figure 9B:
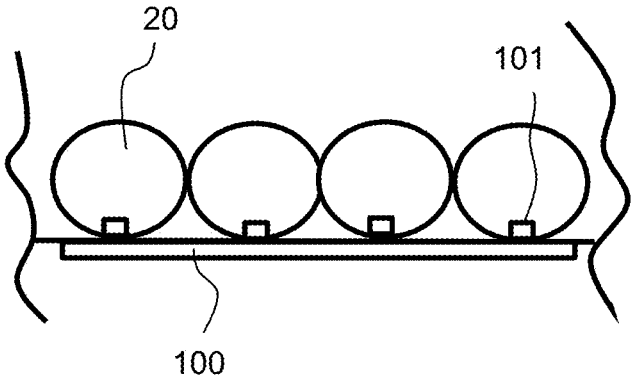
FIG. 9*b* is a side plan view illustrating a game board track and/or tokens comprising one or more magnets in accordance with some embodiments of the presently disclosed subject matter.

In addition (or instead of) an inclined track that moves tokens 20 via gravity, the tokens can be pushed along track 15 using spring-loaded mechanism 95 as illustrated in FIG. 9*a*. The term "spring loaded mechanism" refers to any element that can be biased or urged into at least one position by a spring or similar component. Alternatively or in addition, the track and tokens can include magnets 100, 101 as shown in FIG. 9*b*. The term "magnet" includes any element that generates a magnetic field outside itself, such as permanent magnets, electromagnets, and the like. The attraction between track magnet 100 and token magnet 101 (and/or between two token magnets) can be used to retain the token within the track and/or move the tokens from first track end 60 towards second end 65 as other tokens are removed. It should therefore be appreciated that any mechanism that advances tokens 20 along track 15 can be used. Alternatively, players can be required to manually move the remaining tokens along the track as part of the method of play, rather than a mechanism of the game board.

Figure 10:
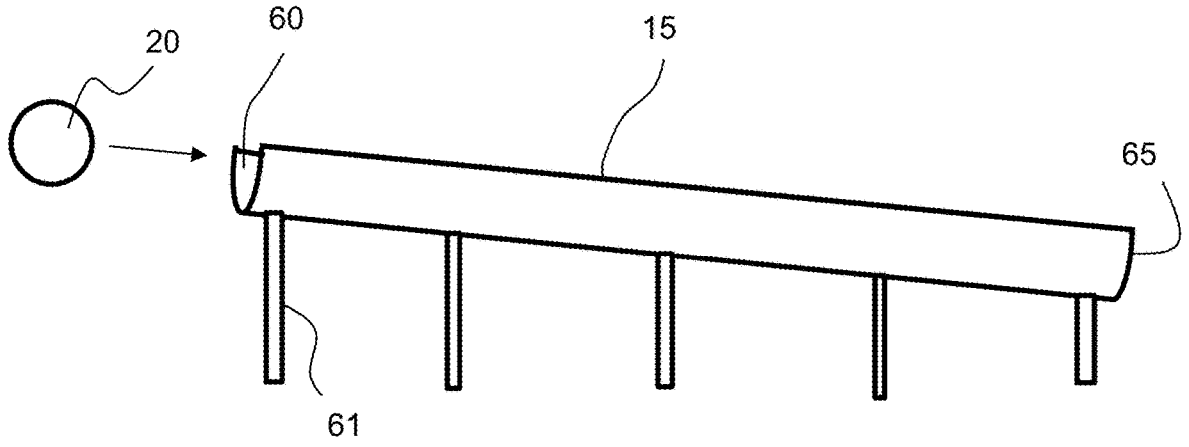
FIG. 10 is a perspective view of an alternate raised track design in accordance with some embodiments of the presently disclosed subject matter.

In an alternate embodiment, one or more tracks can be configured as a partially enclosed tube, as shown in FIG. 10. Each tube includes first and second ends 60, 65, wherein the first end has a height greater than the second end to form a gradient. The tubes can include a series of support legs 61 of various heights to create a gradient. The term "leg" refers to any foundation that can support the track. Each leg can have a length of about 0.5-6 inches or more. Legs 61 can be constructed from any well-known materials and in a wide variety of sizes and shapes.

Figure 11:
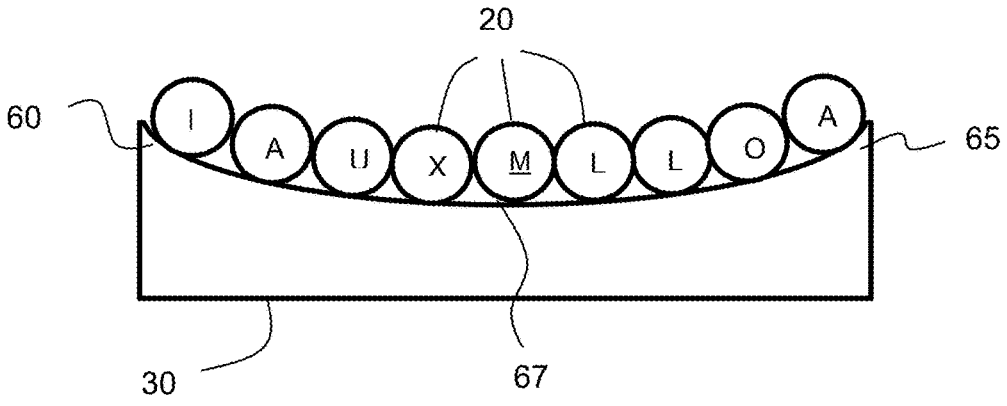
FIG. 11 is a side plan view of an alternate concave track design in accordance with some embodiments of the presently disclosed subject matter.

In a second alternate embodiment, track 10 can have a concave configuration, as shown in FIG. 11. The term "concave" refers to a surface having an arcuate form that can be formed by a series of straight or flat portions that are curved, partially curved, or interconnected. In such embodiments, the height of the track increases at first and second ends 60, 65. Tokens 20 can be added to either end of the track. In use, the pieces roll to the center of the track to the concavity, filling voids left by removed tokens, while also preserving the order of the tokens. The tokens therefore move from both track ends towards the lowest height in the center 67 of the track.

Game board 10 can be constructed in any desired configuration. For example, the board can have a circular, oval, square, rectangular, triangular, pentagonal, hexagonal, octagonal, cross, heart, or abstract shape.

Figure 12A:
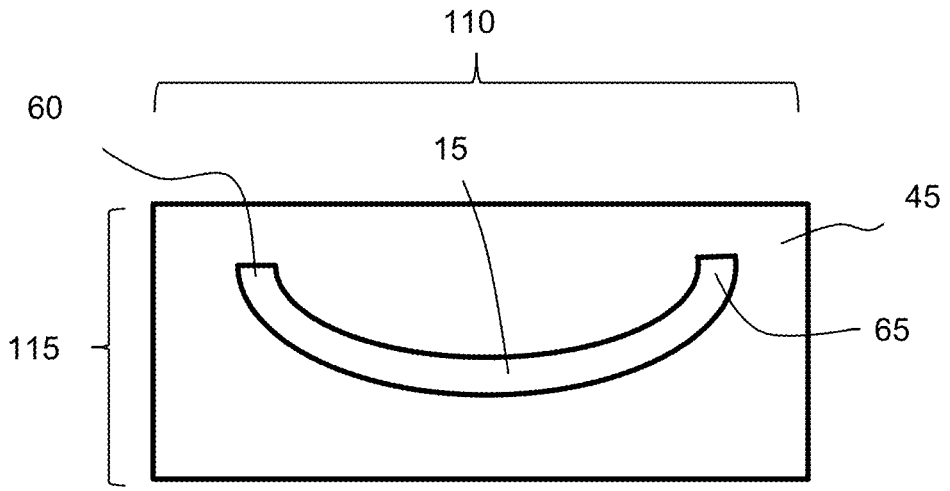
FIG. 12*a* is a top plan view of a game board depicting the board length and width in accordance with some embodiments of the presently disclosed subject matter.
Figure 12B:
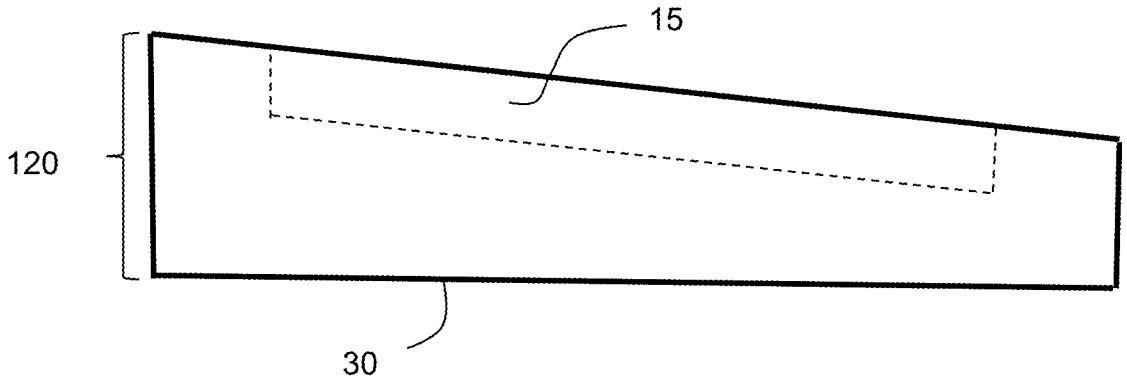
FIG. 12*b* is a side plan view of a game board depicting the board height in accordance with some embodiments of the presently disclosed subject matter.
Figure 13A:
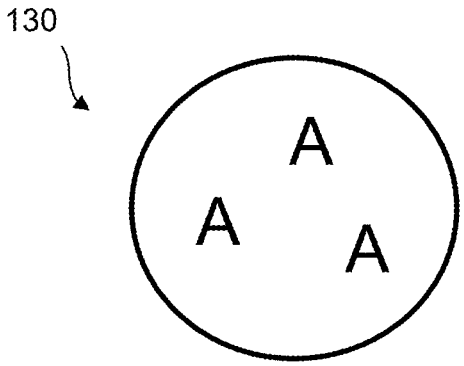
FIGS. 13*a* and 13*b* are front plan views of spherical game tokens in accordance with some embodiments of the presently disclosed subject matter.
Figure 13B:
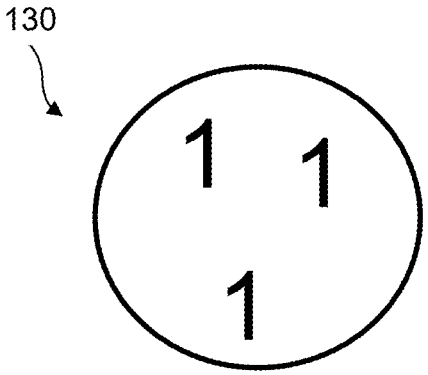
Figure 13C:
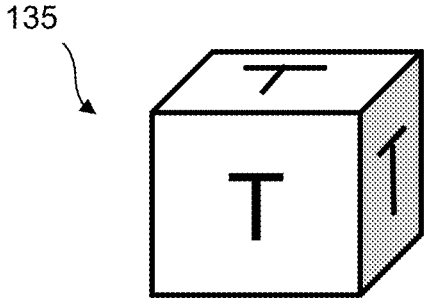
FIG. 13*c* is a perspective view of a game token configured as a cube in accordance with some embodiments of the presently disclosed subject matter.
Figure 13D:
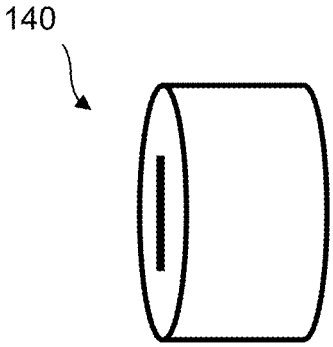
FIGS. 13*d* and 13*e* are perspective views of game tokens configured in a cylindrical configuration in accordance with some embodiments of the presently disclosed subject matter.
Figure 13E:
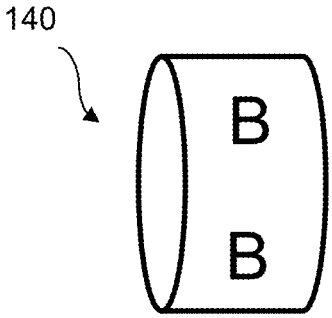
Figure 13F:
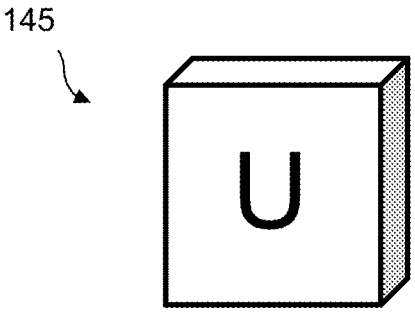
FIG. 13*f* is a perspective view of a game token configured as a slender piece in accordance with some embodiments of the presently disclosed subject matter.

Further, the game board can be constructed with any desired length, width, and height, as shown in FIGS. 12*a* and 12*b*. For example, the board can include length 110 and/or width 115 of about 5-30 inches (e.g., at least/no more than about 5, 6, 7, 8, 9, 10, 11, 12, 13, 14, 15, 16, 17, 18, 19, 20, 21, 22, 23, 24, 25, 26, 27, 28, 29, or 30 inches). The "board length" refers to the longest horizontal straight-line distance of the board. The "board width" refers to the longest straight-line perpendicular to the board length. Board 10 can further include height 120 of about 5-20 inches (e.g., at least/no more than about 5, 6, 7, 8, 9, 10, 11, 12, 13, 14, 15, 16, 17, 18, 19, or 20 inches). The "board height" refers to the longest vertical distance from the board bottom face to the tallest point of the body. It should be appreciated that board 5 can have any suitable dimensions and is not limited to the ranges set forth herein.

The playing board can be constructed from any desired material, such as (but not limited to) plastic, metal, wood, ceramics, rubber, cardboard, or combinations thereof.

Figure 14A:
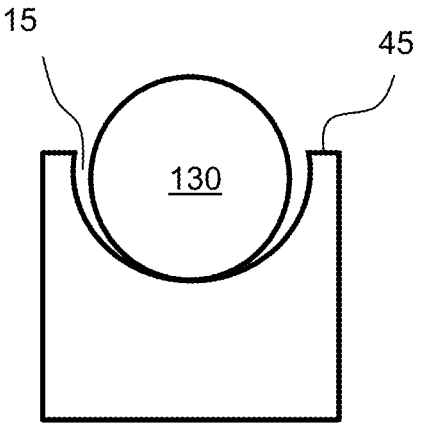
FIGS. 14*a*-14*d* are cross-sectional views of tokens positioned in game tracks in accordance with some embodiments of the presently disclosed subject matter.
Figure 14B:
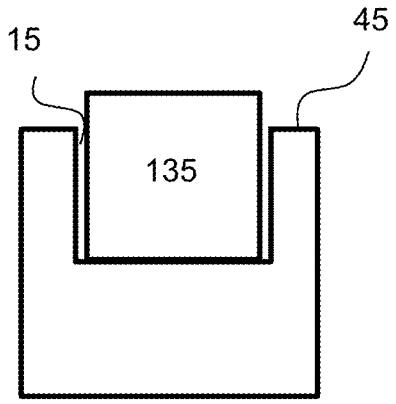
Figure 14C:
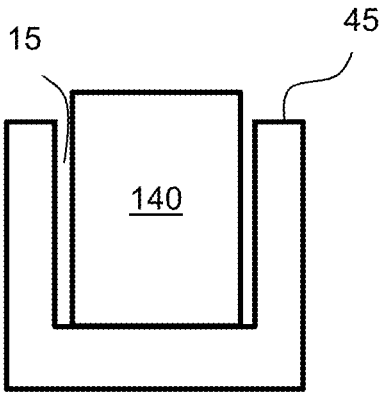
Figure 14D:
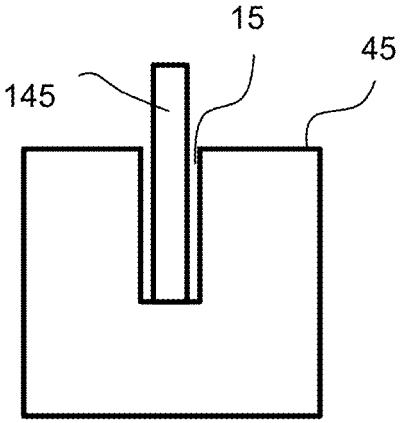

As set forth above, game 5 includes a plurality of game tokens 20 that are positioned fully or partially within track 15. The term "token" refers to any game piece that can include one or more indicators used to spell words and the like as set forth herein. Tokens 20 can be configured in any three-dimensional shape, such as (but not limited to) sphere 130, cube 135, cylinders 140, and/or pieces 145, as shown in FIGS. 13*a*-13*f*. It should be appreciated that tokens 20 can have any desired shape that can move along track 15. For example, when the token is configured as a cylindrical or spherical shape, it can easily roll along track 15, as shown in FIGS. 14*a* and 14*b*. When tokens 20 are cubes or pieces, they can be slid along track 15, as shown in FIGS. 14*c* and 14*d*.

Figure 15A:
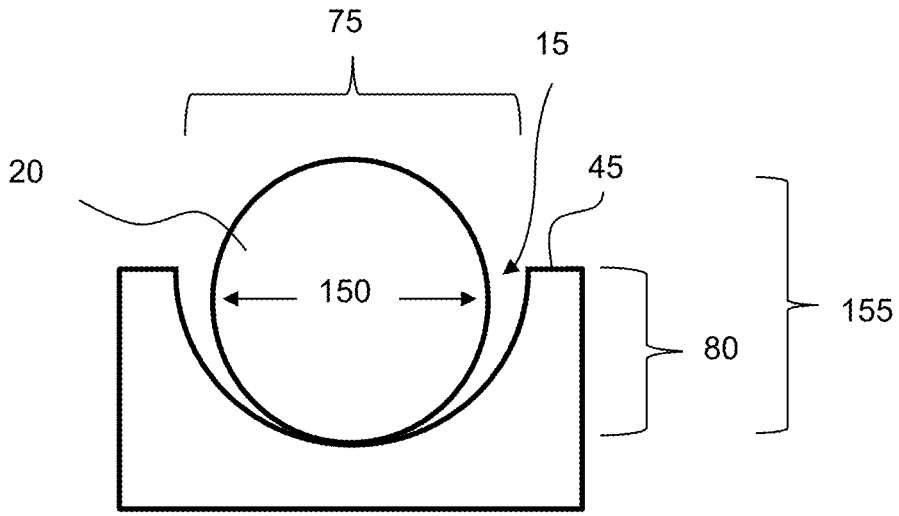
FIGS. 15*a* and 15*b* are cross-sectional views illustrating game token width and height relative to the board track in accordance with some embodiments of the presently disclosed subject matter.
Figure 15B:
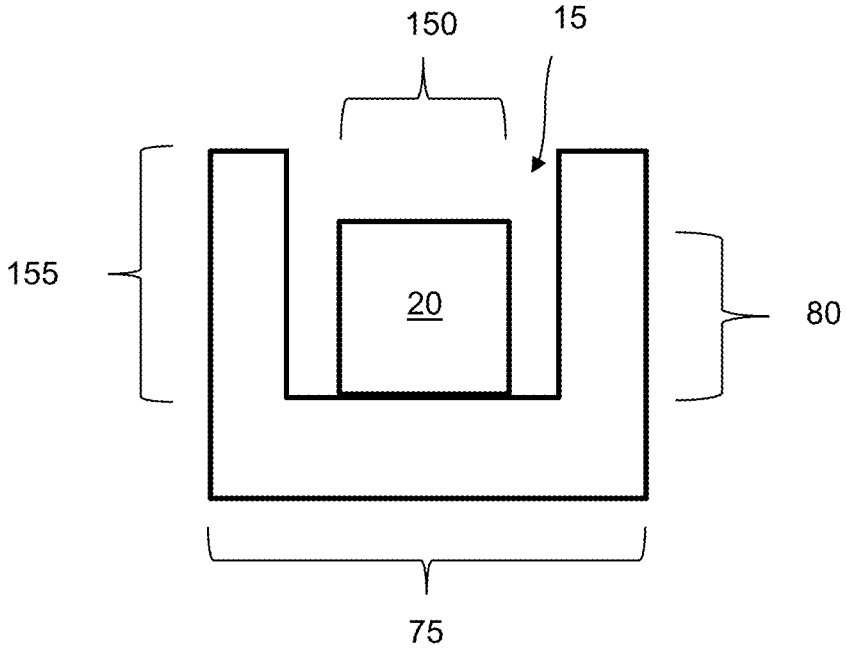
Figure 15C:
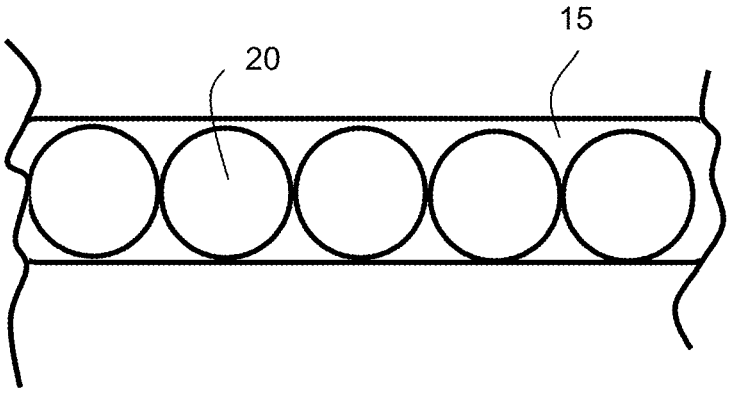
FIG. 15*c* is a top plan view illustrating a plurality of game tokens configured on a track in accordance with some embodiments of the presently disclosed subject matter.

Each token can have width 150 that is less than the width of track 15 to allow the tokens to easily travel from first end 60 to second end 65, as shown in FIG. 15*a*. Thus, each token can be about 1-50 percent smaller in width compared to channel width 75 (e.g., at least/no more than about 1, 5, 10, 15, 20, 25, 30, 35, 40, 45, or 50 percent). Thus, if the width of the channel is about 1 inch, the width of corresponding tokens 20 (e.g., the shortest horizontal distance of the token) can be about 0.5-0.99 inches. As illustrated in FIG. 15*a*, each token can further include height 155 (longest vertical distance of the token) that is greater than channel depth 80 to allow the token to be easily gripped and removed if desired by the user. However, the presently disclosed subject matter is not limited, and token height 155 can be about equal to or less than channel depth 80, as shown in FIG. 15*b*. Accordingly, tokens 20 can easily roll or travel down sloped track 15 and do not become wedged or stuck in place. In some embodiments, the tokens can roll along track 15 in a single-file manner, as shown in FIG. 15*c*.

Each token includes one or more indicators 25 on the external surface thereof. The indicator can include a letter, number, symbol, and/or the like. In some embodiments, indicator 25 can be repeated in one or more orientations on a particular token, allowing the letter or symbol to be read from a variety of user positions (e.g., overhead, to the left or right of the board, etc.). For example, each face of the token can include the same indicator (e.g., the letter "A"). However, the presently disclosed subject matter is not limited, and one face of a token can include a different indicator compared to at least one other face or point of the token.

Optionally, one or more tokens can be configured without indicator 25, and/or with a special "wild" symbol. In such embodiments, the token can be considered a "blank" token, allowing the user to substitute any desired letter or symbol.

In some embodiments, the indicator can be a letter (A, B, C, D, etc.). One or more letters can be underlined to avoid ambiguity between letters that appear similar when rotated, such as "M" and "W." The game can include at least one token with each letter of the alphabet. In some embodiments, the game can include duplicate pieces with letters commonly used in the English language (e.g., A, E, S, T, L, N). In some embodiments, one or more tokens can include multiple letters. For example, a particular token can include the letters "QU" since the letter "Q" typically requires the letter "U" to follow in English words. Similarly, a single token can include the letters "PH", "STR", or "EA", or any other commonly used letter combinations. Similarly, one or more tokens 20 can include common prefixes (e.g., "un-", "bi-", "pre-", "in-", and the like) and/or suffixes (e.g., "-ed", "-ing", "-er", etc.). Further, each token can include one or more entire words such that players form grammatically correct sentences or phrases from tokens 20. As a result, the game can easily adapt to languages that use single symbols to represent words, such as Chinese.

In some embodiments, tokens 20 collectively include all of the letters of the alphabet, to varying degrees. For example, letters that are used most often in a particular language (e.g., S, T, E, R) can be more prevalent than letters that are more infrequently used (e.g., X, V, K). Thus, game 5 can include a single copy of very rarely used letters (J, K, Q, X, Z), two copies of rarely used letters (B, C, D, F, G, H, M, P, V, W, Y), three copies of more commonly used letters (L, N, R, T, U), and five copies of the most commonly used letters (E, A, I, O, S). However, it should be appreciated that such an arrangement is merely one example of many token configurations possible in game 5.

It should be appreciated that indicators 25 are not limited to the English language. Thus, one or more tokens can include letters with diacritical markings, or use non-Roman scripts (e.g., Cyrillic or Arabic). In these embodiments, players can form words of a language appropriate to the characters, rather than English words. In addition, the method of play can generalize to any set of symbols with criteria for the validity of sequences of those symbols. As examples (but with many others possible), players may be required to form abecedarian words or sequences, whose letters are in alphabetical order, or required to form prime numbers from sequences of digits.

Game 5 can have any desired number of tokens 20, such as (but not limited to) about 25-200. Thus, the game can include at least about (or no more than about) 25, 30, 35, 40, 45, 50, 55, 60, 65, 70, 75, 80, 85, 90, 95, 100, 105, 110, 115, 120, 125, 130, 135, 140, 145, 150, 155, 160, 165, 170, 175, 180, 185, 190, 195, or 200 tokens. However, game 5 is not limited and can include fewer or more tokens than the range given herein.

In some embodiments, game 5 can further include a word-validating device, such as a dictionary. The word validating device can be configured as an actual book or booklet and/or a mobile application.

Tokens 20 and game board 10 can be used together to play the disclosed game. In some embodiments, the tokens and game board can be physical components. In other embodiments, game 5 can be played as a video game, computer program, mobile application, internet game, social network game, or any other type of electronic game. In some of these embodiments, the tokens and/or playing surfaces can be digital representations.

The game can be played by one or more players. In some embodiments, a player can play with or against other players and/or computer opponents. In other embodiments, players can be grouped into teams that play with or against one another. In still other embodiments, a single player can play the game to attempt to get a high score or achieve other objectives.

Figure 16:
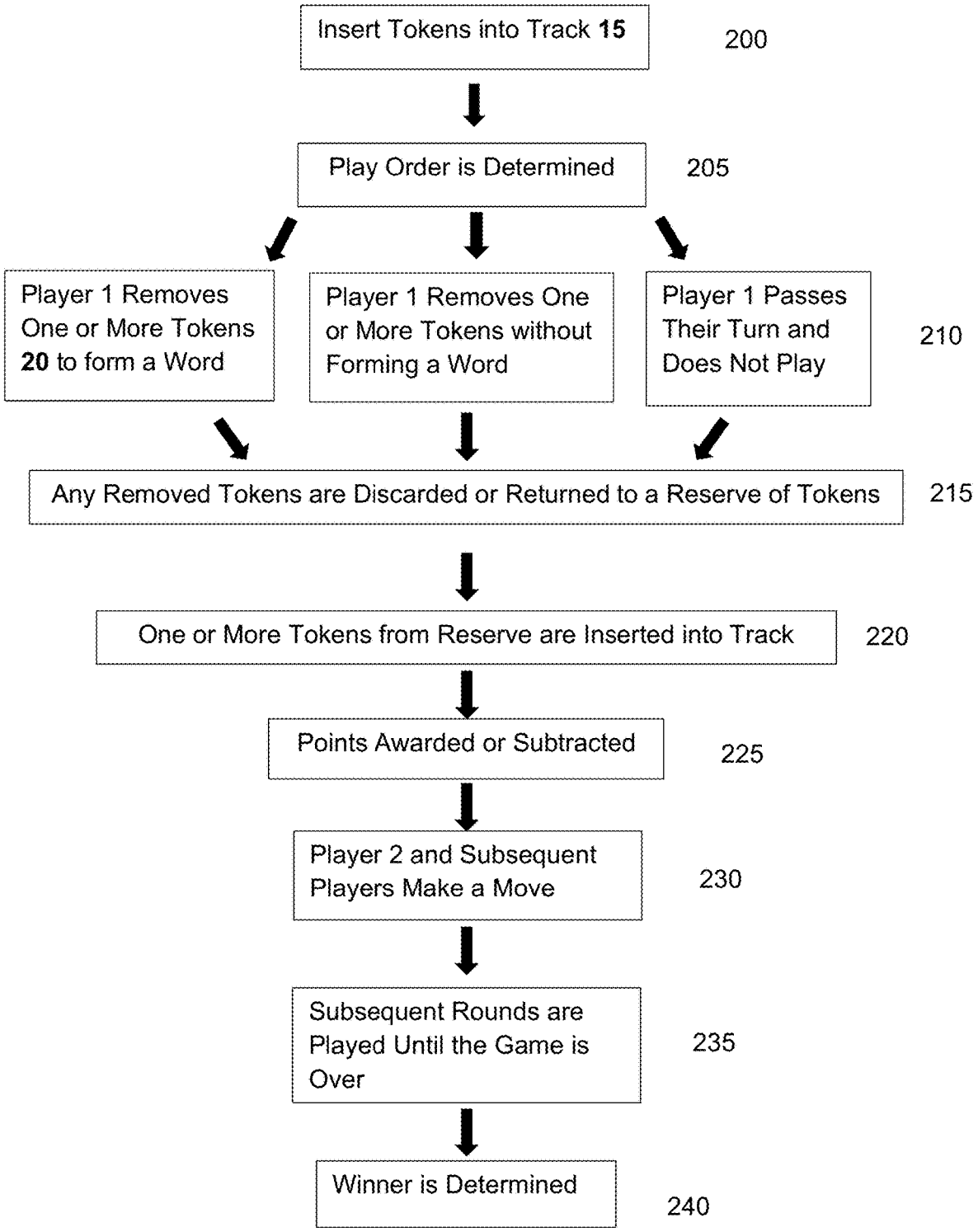
FIG. 16 is a flow chart illustrating one method of playing game 5 in accordance with some embodiments of the presently disclosed subject matter.

FIG. 16 is a flow diagram illustrating one method of playing game 5. To start the game, each player or team randomly inserts a number of tokens 20 into track 15 at step 200, as illustrated in FIG. 17*a*. FIGS. 17*b* and 17*c* illustrate an alternative view of the board of FIG. 17*a*, with first and second curved ends 66, 67 with central portion 68 upon which the board can rest on a support surface (e.g., a table). Alternatively, a predefined initial sequence of pieces can be added to the track. Each player/team can have their own track, or there can be a single track for all players/teams to share. Prior to initiating game play, the first player to move is determined at step 205. Order of play can be determined by rolling a chance device (e.g., a die), random selection, drawing a token (e.g., the token closest to "A" goes first), or any other method that selects a player to make a first move.

Figure 17D:
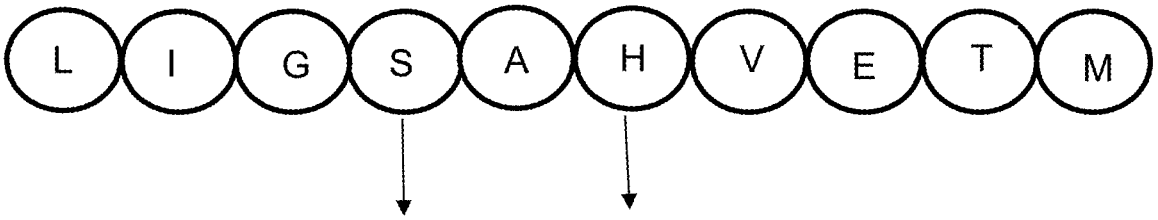
FIGS. 17*d* and 17*e* illustrate removing a plurality of tokens to form a word during game play in accordance with some embodiments of the presently disclosed subject matter.
Figure 17E:
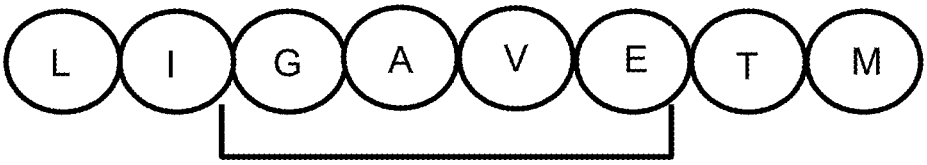

At step 210, Player 1 makes a first game move. Player 1 can choose to strategically remove one or more tokens from track 15, forming a word in adjacent tokens, as illustrated in FIGS. 17*d* and 17*e*. As shown, tokens "C" and "H" are removed from the track to form the word "GAVE." If a token is removed, a word can be spelled only if that word begins with a token that was to the left of the removed token and ends with a token that was to the right of the removed token. In other words, the word spelled was not on the board contiguously before the turn. Rather, the word was created by the removal of the token. The word remains on the board, and Player 1's turn ends. In some embodiments, a Player can remove tokens without forming a word. Thus, players can spell words in a given track configuration, as well as build fragments of words strategically so that longer words are possible during subsequent plays. Alternatively, Player 1 can pass their turn.

At step 215, the removed tokens can be discarded into a reserve pile, returned to a reserve pile, or can be reinserted into the track at first end 60. Each time a token is removed, the remaining tokens positioned above the removed token will roll down the track (towards second end 65) due to gravity to fill the vacant space. The track is then refilled with tokens from the reserve or removed tokens can be directly inserted into the track. In some embodiments, after a word is played, the tokens corresponding to that word are removed and/or discarded. In other embodiments, the tokens are reinserted into the track (e.g., at first end 60 of the track although any location can be used). In still other embodiments, there can be a stealing mechanism whereby a player can take a tile discarded by another player and add it to one end of their own track (but not between any existing tiles, so that the order of the tiles is preserved).

In some embodiments, the tokens are arranged such that a word is formed without a player having to remove any tokens.

In some embodiments, if Player 1 cannot form a word, they can pass their turn and game play moves forward to Player 2.

It should be appreciated that Player 2 cannot use the exact tiles used by Player 1 to form a word because they must remove a tile. However, Player 2 can form the same word again (or a modification of that word) by removing a token.

In some embodiments, Player 1 receives a penalty when they pass (e.g., a deduction in points). In a particular embodiment, if all of the players pass their turns for a particular configuration of tokens in the play area (i.e., all of the players pass their turns in a row), the game can then end and a winner may be selected based on the player who has the most points at that moment in time.

After each Player takes a turn, points are calculated for that turn at step 220. Upon selecting an ordered set of tokens that spell out a word, a number of points are awarded to the player based on the tokens used in forming the word. For example, in one embodiment, each token has an assigned point value, and the total number of points in each token used to spell the word is assigned to the Player. In other embodiments, scoring is at least partially based on word length. In still further embodiments, the point value for a particular play is based on both word length and the token value. One example of a point value assigned to each letter is set forth below in Table 1. However, it should be appreciated that the scoring set forth in Table 1 is merely one example, and any of a wide variety of point values can be assigned to each token.

TABLE 1

Representative Token Letter Values

| Letter | Point Value | Letter | Point Value | Letter | Point Value |
|---|---|---|---|---|---|
| A | 0 | B | 2 | C | 3 |
| D | 1 | E | 0 | F | 2 |
| G | 1 | H | 1 | I | 0 |
| J | 5 | K | 4 | L | 0 |
| M | 0 | N | 0 | O | 0 |
| P | 2 | Q | 7 | R | 0 |
| S | 0 | T | 0 | U | 0 |
| V | 3 | W | 3 | X | 5 |
| Y | 3 | Z | 5 | | |

To calculate a word score, the value of each token is looked up to assign a point value to the word. In some embodiments, the value of a given word is calculated based on word length, as set forth in Table 2, below. The score based on word length can be used alone or added to the score calculated by the token letter values of Table 1 (e.g., as a bonus score based on word length).

TABLE 2

Representative Word Length Values

| Word Length (No. of Tokens) | Point Value |
|---|---|
| 1-2 | 0 |
| 3 | 1 |
| 4 | 3 |
| 5 | 5 |
| 6 | 8 |
| 7 | 13 |
| 8 | 21 |
| >8 | 25 |

Optionally, points can be deducted if tokens are removed. For example, the point value of the token can be deducted and/or a universal number of points can generally be deducted if a token is removed. In other embodiments, points are not subtracted but are only awarded for spelling words.

After Player 1 has either played or passed, Player 2 takes a turn at step 225. If there are additional players, game play proceeds until each player takes a turn before Player 1 makes his or her second move at step 230. Any desired number of rounds are played using the method described above.

Figure 18:
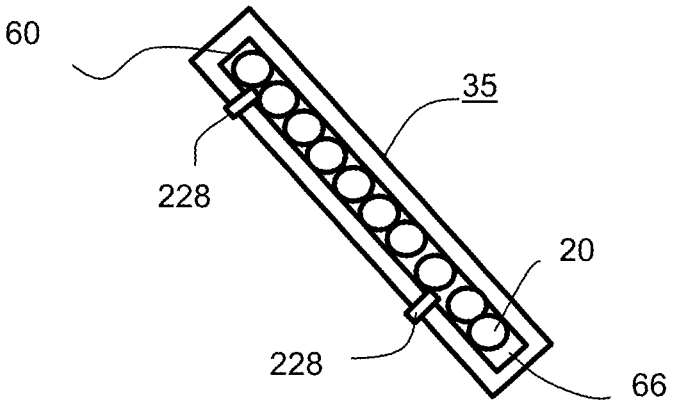
FIG. 18 is a top plan view of a game board track in accordance with some embodiments of the presently disclosed subject matter.

In some embodiments, the board can include placement tokens 228 that indicate the position of players on the board. For example, the tokens can be placed proximally to a particular token or on regions of the track. The placement tokens can be held in position using any conventional technique, such as (but not limited) to the use of magnets, VELCRO®, fasteners, clips, and the like. One example is shown in FIG. 18. Placement tokens 228 can have the same shape as letter tokens 20, or can have a different shape.

Figure 19A:
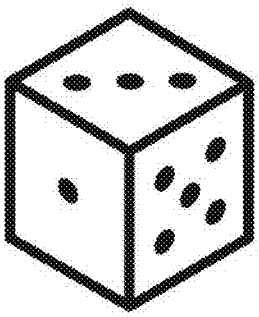
FIG. 19*a* is a perspective view of a game die in accordance with some embodiments of the presently disclosed subject matter.
Figure 19B:
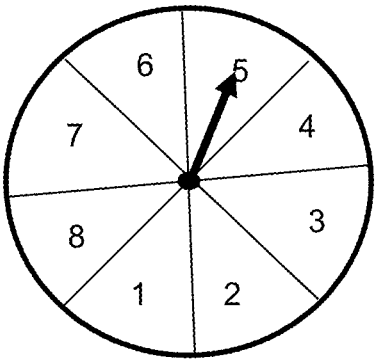
FIG. 19*b* is a top plan view of a game spinner in accordance with some embodiments of the presently disclosed subject matter.

A device of chance can be used to determine whether a player can take certain actions on his or her turn (e.g., removing a tile, forming a word, moving a token to another region of the board, etc.). Suitable chance devices can include (but are not limited to) one or more dice, spinners, and the like, as shown in FIGS. 19*a* and 19*b*.

At step 235, the game is over and the winner is determined. In some embodiments, the game ends after each player has played a predetermined number of rounds (e.g., 20 rounds), where each player or team takes a single turn per round. In other embodiments, the game ceases when a player or team reaches a certain score (e.g., 200 points). In still other embodiments, the game ceases when all or a set percentage of the tokens have been used, or when no more words can be played. Further, in some embodiments, the game (or a particular player/team turn) can have a time limit, as determined by a clock, buzzer, hourglass, or other timing device.

In some embodiments, the players share a single track on game board 10. However, in other embodiments, each player is assigned their own game board, with their own sequence of tokens. In still other embodiments, each board can include more than one track 15, each track assigned to a certain player or team.

Game 5 provides many benefits over prior art spelling games. Particularly, the disclosed game is educational, allowing players to expand their vocabularies and improve their spelling skills. Thus, the disclosed game has educational value for students, adults, and those learning a second language.

In addition, game 5 provides entertainment for players by allowing individual players or team to strategize to spell words that accumulate the greatest number of points.

Game 5 can be enjoyed by a wide variety of players, including children, adults, and the elderly.

Further, the additional constraint of preserving the ordering of letters challenges spelling skills beyond other games currently on the market.

As described above, although a preferred embodiment of the present invention has been described for illustrative purposes, those skilled in the art will appreciate that various modifications, additions and substitutions are possible, without departing from the scope and spirit of the invention a s disclosed in the accompanying claims.

What is claimed is:

1. A method of playing a game, the method comprising:

positioning a plurality of tokens within a game board channel, the game board comprising:

a game board defined by a bottom support surface and a top playing surface with a height;

at least one track configured as a channel within the top playing surface, wherein each track includes a mechanism that advances one or more tokens along the track;

a plurality of tokens sized and shaped to be at least partially housed within the one or more tracks in a received order, each token comprising indicators selected from at least one letter of the alphabet;

wherein when a token is removed from a track, any tokens positioned before the removed token in the received order will advance along the track towards tokens positioned after the removed token in the received order;

removing one or more tokens by a first player to form a word using adjacent tokens positioned along the track;

awarding points to the first player based on the length of the word formed, the one or more tokens used to form the word, the speed with which the word was formed, or combinations thereof;

repeating the removing and awarding points steps for subsequent players to form a round;

playing subsequent rounds;

ending the game when a predetermined number of plays have been made for each player, when a player reaches a predetermined score, or when no more words can be formed, wherein the player with the highest number of points at the end of the game is declared the winner.

2. The method of claim 1, wherein the track is defined by:

a first end comprising a first height;

a second end comprising a second height; and a length spanning the first and second ends;

wherein the first height is greater than the second height such that the track comprises a gradient from the first end to the second end and the mechanism that advances one or more tokens along the track is the slope created by the gradient.

3. The method of claim 1, wherein each player is assigned their own track on the game board.

4. The method of claim 1, wherein each player shares a single track on the game board.

5. The method of claim 1, wherein the indicator is selected from a single letter, two or more letters, a single word, two or more words, or combinations thereof.

6. The method of claim 1, wherein each track has a spiral, linear, zig-zag, angled, or curved shape.

7. The method of claim 1, wherein the mechanism that advances one or more tokens along the track is defined as a spring-loaded mechanism positioned at the first end of the track.

8. The method of claim 1, wherein the game board comprises first and second ends with a length therebetween, wherein the first and second ends have a height that is greater than the remainder of the game board length.

9. The method of claim 1, wherein the at least one track includes an adjacent lip configured along a length of the track, with a depth of about 0.1-1 inches.

10. The method of claim 1, wherein the at least one track is configured as a partially enclosed tube supported by a series of legs of various heights.

11. The method of claim 1, wherein the track and plurality of tokens comprise magnets that attract each other.

12. The method of claim 1, wherein the tokens are spherical or cylindrical in shape.

13. The method of claim 1, wherein the tokens are cubes or square tiles.

14. The method of claim 1, wherein each token comprises indicators selected from at least one word and points are awarded based on creating grammatically correct sentences or phrases.

15. The method of claim 1, wherein removed tokens are reinserted into the track.

* * * * *